US011420311B2

(12) United States Patent
Goto

(10) Patent No.: US 11,420,311 B2
(45) Date of Patent: Aug. 23, 2022

(54) INSERT INSERTION TOOL AND METHOD FOR INSERTING INSERT

(71) Applicant: Sanyu Seiki Corporation, Tokyo (JP)

(72) Inventor: Tamaki Goto, Tokyo (JP)

(73) Assignee: SANYU SEIKI CORPORATION, Tokyo (JP)

( * ) Notice: Subject to any disclaimer, the term of this patent is extended or adjusted under 35 U.S.C. 154(b) by 0 days.

(21) Appl. No.: 17/603,167

(22) PCT Filed: Aug. 30, 2019

(86) PCT No.: PCT/JP2019/034223
§ 371 (c)(1),
(2) Date: Oct. 12, 2021

(87) PCT Pub. No.: WO2020/246050
PCT Pub. Date: Dec. 10, 2020

(65) Prior Publication Data

US 2022/0088757 A1 Mar. 24, 2022

(30) Foreign Application Priority Data

Jun. 4, 2019 (JP) ..... JP2019-104357
Aug. 27, 2019 (JP) ..... JP2019-155088

(51) Int. Cl.
*B25B 27/14* (2006.01)

(52) U.S. Cl.
CPC ..... *B25B 27/143* (2013.01)

(58) Field of Classification Search
CPC ..... B25B 27/14; B25B 27/143; B25B 27/146; B25B 27/16; B25B 27/18; B25B 27/20;
(Continued)

(56) References Cited

U.S. PATENT DOCUMENTS 4,536,115 A 8/1985 Helderman
4,647,072 A 3/1987 Westman
(Continued)

FOREIGN PATENT DOCUMENTS

CN 104723247 A 6/2015
CN 106457492 A 2/2017
(Continued)

OTHER PUBLICATIONS

Notification of Reasons for Refusal in corresponding JP Application No. 2019-155088, dated Dec. 24, 2019, and its English translation, 5 pgs.
(Continued)

*Primary Examiner* — Robert J Scruggs
(74) *Attorney, Agent, or Firm* — Young Basile Hanlon & MacFarlane, P.C.

(57) ABSTRACT

An insert insertion tool includes a mandrel on which an insert is mounted, and a coating member. The coating member is configured to apply ink to a rear end of the insert on an opposite side of a tip end of the insert that first enters a tap hole. Accordingly, the insert inserted into the tap hole stands out on a surface of a workpiece, and a user is capable of visually recognizing whether or not the insert has been inserted into the tap hole. Thus, the confirmation work becomes easy, and it is possible to improve the work efficiency.

12 Claims, 8 Drawing Sheets

(58) Field of Classification Search
CPC ..... B25B 27/24; B25B 27/28; B25B 27/30; B25B 27/302; B25B 27/304; B25B 27/306; B25B 27/308; B23P 19/04; B21C 37/15; B21H 3/00; B21J 15/50
See application file for complete search history.

(56) References Cited

U.S. PATENT DOCUMENTS

| | | | | |
|---|---|---|---|---|
| 5,456,145 | A | 10/1995 | Cosenza | |
| 9,421,676 | B2 * | 8/2016 | Hondo | B25B 27/00 |
| 9,550,287 | B2 * | 1/2017 | Li | B25B 27/143 |
| 2009/0158569 | A1 * | 6/2009 | Yui | B25B 27/143 29/240.5 |
| 2009/0293248 | A1 | 12/2009 | Sato | |
| 2012/0096993 | A1 * | 4/2012 | McCullough | B25B 23/0035 81/177.2 |
| 2015/0283688 | A1 | 10/2015 | Szewc et al. | |
| 2016/0256990 | A1 | 9/2016 | Szewc et al. | |
| 2017/0021484 | A1 | 1/2017 | Szewc et al. | |

FOREIGN PATENT DOCUMENTS

| | | | |
|---|---|---|---|
| JP | S53-115999 | A | 10/1978 |
| JP | H04-076369 | U | 7/1992 |
| JP | H07-001359 | A | 1/1995 |
| JP | H08-090442 | A | 4/1996 |
| JP | 2007-105830 | A | 4/2007 |
| JP | 2009-291860 | A | 12/2009 |

OTHER PUBLICATIONS

International Preliminary Report on Patentability and Written Opinion of the Internaional Search Authority (WO/ISA) in PCT/JP2019/034223, dated Dec. 16, 2021, with its English translation, 7 pgs.
European Search Report for Application No. 19931673.8, dated May 16, 2022, 7 pgs.

* cited by examiner

INSERT INSERTION TOOL AND METHOD FOR INSERTING INSERT

TECHNICAL FIELD

The present invention relates to an insert insertion tool and a method for inserting an insert.

BACKGROUND

Usually, when a strong female screw is required, such as when the durability of the female screw is required or when strong tightening is required, an insert called a coil insert or a screw insert is used, for example. The insert is formed by winding a wire rod such as stainless steel in a coil shape, and is inserted (embedded) while being screwed into a tap hole (screw hole) of a workpiece such as resin or aluminum alloy by an insert insertion tool. As the insert, there are an insert with a tongue and a tongueless insert, and an insert insertion tool corresponding to each of these is used.

In general, the color of the insert is silver such as stainless steel, and the color of the workpiece such as aluminum alloy is often the same color or a similar color. Therefore, the insert inserted into the tap hole of the workpiece does not stand out on the surface of the workpiece, and it is difficult for a user to visually recognize whether or not the insert has been inserted into the tap hole. As a result, the user tries screwing a screw into the insert inserted in the tap hole and confirms whether or not the insert has been inserted into the tap hole. Because this confirmation work takes time and is performed for each tap hole, work efficiency is lowered.

An example of the above is shown in JP Patent Publication No. 2009-291860 A.

BRIEF SUMMARY

An object to be solved by the present invention is to provide an insert insertion tool and a method for inserting an insert capable of improving work efficiency.

According to an embodiment of the present invention, an insert insertion tool includes a mandrel on which an insert is mounted, and a coating member configured to apply ink to a rear end on an opposite side of a tip end that first enters a tap hole of the insert.

In the insert insertion tool, the coating member may have an ink holding member that holds the ink, and the ink holding member may be in contact with the rear end of the insert mounted on the mandrel.

In the insert insertion tool, the ink holding member may be formed to be movable along an extending direction of the mandrel, and include a pressing member for pressing the ink holding member against the rear end of the insert mounted on the mandrel.

In the insert insertion tool, the coating member may have the ink holding member that holds the ink, and the ink holding member may be in contact with the rear end of the insert inserted into the tap hole.

In the insert insertion tool, an accommodating member configured to accommodate the coating member may be provided, and the accommodating member may have a supply hole for supplying the ink to the coating member.

According to another embodiment of the present invention, a method for inserting an insert includes mounting an insert on a mandrel provided in an insert insertion tool, applying ink to a rear end on an opposite side of a tip end that first enters a tap hole, of the insert mounted on the mandrel by a coating member provided in the insert insertion tool, and inserting the ink-coated insert into the tap hole by the insert insertion tool.

According to still another embodiment of the present invention, a method for inserting an insert includes mounting an insert on a mandrel provided in an insert insertion tool, inserting the insert mounted on the mandrel into a tap hole by the insert insertion tool, and applying ink to a rear end on an opposite side of a tip end that first enters the tap hole of the insert inserted into the tap hole by a coating member provided in the insert insertion tool.

According to the embodiments of the present invention, it is possible to improve work efficiency.

DETAILED DESCRIPTION

First Embodiment

A first embodiment will be described with reference to FIGS. 1 to 7. The up-down and right-left directions in the first embodiment are based on the drawings.

Basic Configuration

Figure 1:
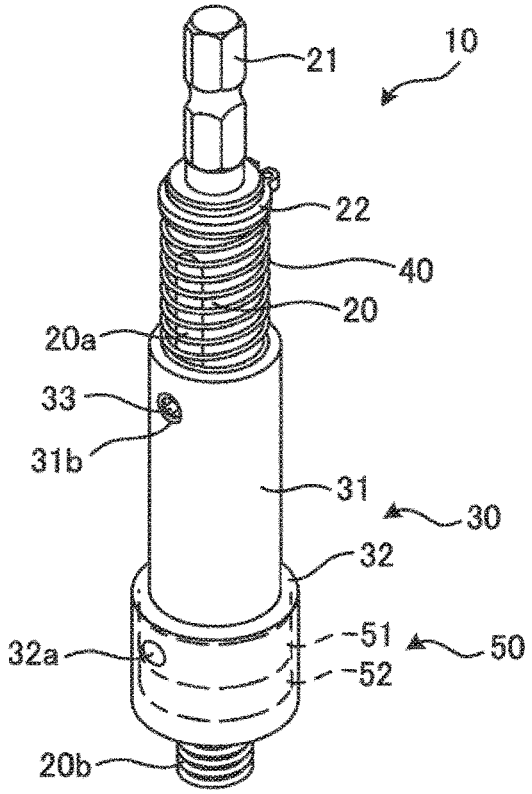
FIG. 1 is a perspective view illustrating an insert insertion tool according to a first embodiment.
Figure 2:
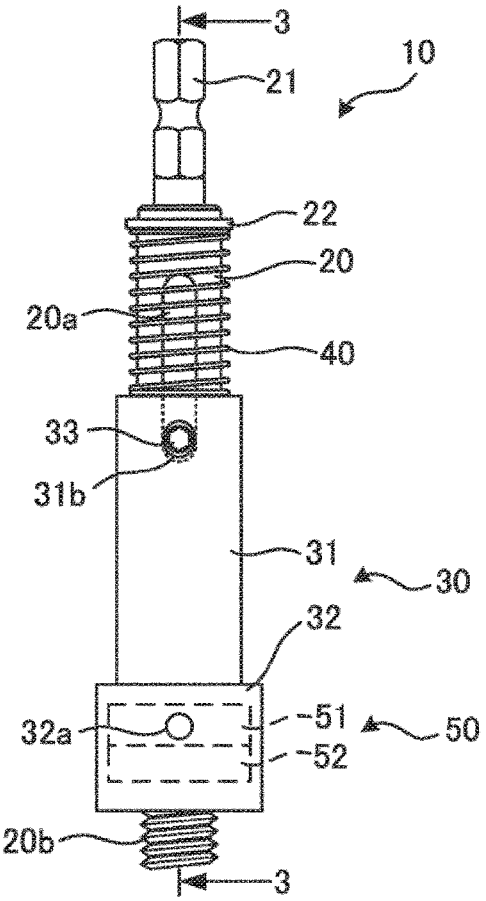
FIG. 2 is a front view illustrating the insert insertion tool according to the first embodiment.
Figure 3:
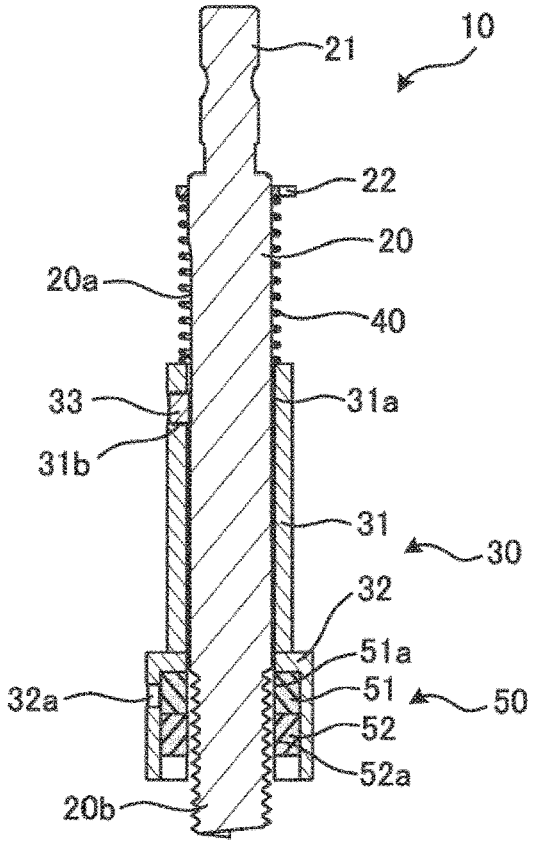
FIG. 3 is a sectional view taken along line 3-3 of FIG. 2.

As illustrated in FIGS. 1 to 3, an insert insertion tool 10 according to an embodiment includes a mandrel (mandl) 20, an accommodating member 30, a pressing member 40, and a coating member 50. The insert insertion tool 10 is used for inserting (embedding) an insert with a tongue B1 (hereinafter, referred to as insert B1) into a tap hole A2 of a workpiece A1 illustrated in FIG. 5.

The mandrel 20 is formed in a columnar shape, and a hexagonal bit 21 is formed at the upper portion of the mandrel 20. The hexagonal bit 21 functions as a connecting unit for detachably connecting the mandrel 20 to the driving shaft of an automatic screwdriver (for example, an electric screwdriver) or a manual rotating jig. Therefore, it is possible to use the insert insertion tool 10 both automatically and manually. An annular flange member 22 is provided on the outer circumferential surface of the mandrel 20 to be positioned in the vicinity of the root of the hexagonal bit 21. On the outer circumferential surface of the mandrel 20, a groove portion 20*a* is formed to extend in the extending direction of the mandrel 20 from the vicinity below the flange member 22 to the vicinity of the center of the mandrel 20. Furthermore, a male screw 20*b* is formed on the outer circumferential surface of the mandrel 20 on the lower end side (tip end side). The insert B1 is combined with the male screw 20*b*, and the insert B1 is mounted on the mandrel 20 so that a portion of the mandrel 20 extends into the insert B1.

The accommodating member 30 has a main body 31 and an accommodating unit 32. The accommodating member 30 accommodates a part of the mandrel 20 by the main body 31 while accommodating the coating member 50 together with a part of the mandrel 20 by the accommodating unit 32.

The main body 31 is formed in a cylindrical shape and is provided on the mandrel 20 to be movable along the extending direction of the mandrel 20. The mandrel 20 is passed through a through-hole 31*a* of the main body 31 (refer to FIG. 3). A screw hole 31*b* is formed on the upper end side (rear end side) of the outer circumferential surface of the main body 31 to face the groove portion 20*a* of the mandrel 20. The screw hole 31*b* is a through-hole in which a female screw is formed on the inner circumferential surface. A male screw 33 is inserted into the screw hole 31*b*. The male screw 33 protrudes into the groove portion 20*a* to the extent of not being in contact with the bottom surface of the groove portion 20*a* of the mandrel 20, or being in contact with the bottom surface such that the movement (movement in the up-down direction) of the main body 31 is possible. The main body 31 moves within the length range in the extending direction of the groove portion 20*a* along the extending direction of the groove portion 20*a*. Therefore, the groove portion 20*a* determines the moving range of the main body 31 according to the length in the extending direction.

The accommodating unit 32 is integrally provided with the main body 31 at the lower end of the main body 31, and is formed in a cylindrical shape having a diameter greater than the diameter of the main body 31. The annular coating member 50 is attached to the inner surface of the accommodating unit 32. A supply hole 32*a*, which is a through-hole for supplying ink to the coating member 50, is formed on the outer circumferential surface of the accommodating unit 32. The accommodating unit 32 is formed of, for example, a resin material. The accommodating unit 32 functions as a cushioning material that cushions the impact when the accommodating member 30 abuts against the surface of the workpiece A1.

The pressing member 40 is a member that presses the accommodating member 30 toward the lower end side (tip end side) of the mandrel 20. The accommodating member 30 is pressed downward by the pressing member 40, and the male screw 33 of the accommodating member 30 abuts against the lower end of the inner circumferential surface of the groove portion 20*a* of the mandrel 20 (refer to FIG. 3) and is stopped. For example, a biasing member (for example, a spring such as a coil spring) is used as the pressing member 40. The biasing member is provided between the lower surface of the flange member 22 of the mandrel 20 and the upper surface of the main body 31.

Here, when the above-described accommodating member 30 and pressing member 40 are mounted on the mandrel 20 by the user, the pressing member 40 is first mounted on the mandrel 20 from the lower end side thereof. Then, the accommodating member 30 is mounted on the mandrel 20 against the pressing member 40 that abuts against the flange member 22. When the screw hole 31*b* of the main body 31 of the accommodating member 30 faces the groove portion 20*a* of the mandrel 20, the male screw 33 in the screw hole 31*b* protrudes by a predetermined amount (a predetermined amount by which the movement of the accommodating member 30 in the up-down direction is possible) into the groove portion 20*a*. In this manner, the accommodating member 30 and the pressing member 40 are mounted on the mandrel 20.

The coating member 50 has a first ink holding member 51 and a second ink holding member 52. The coating member 50 uses the first ink holding member 51 and the second ink holding member 52 to apply ink to the rear end on the opposite side of the tip end that first enters the tap hole A2 in the insert B1.

The first ink holding member 51 and the second ink holding member 52 are formed in an annular shape, and the outer diameter, the inner diameter, the thickness, and the width (ring width) of the respective rings are the same. The first ink holding member 51 and the second ink holding member 52 are laminated such that the first ink holding member 51 is the upper layer and the second ink holding member 52 is the lower layer (two-layered structure). The first ink holding member 51 and the second ink holding member 52 move together with the accommodating unit 32 along the extending direction of the mandrel 20 according to the movement of the accommodating member 30. The mandrel 20 is passed through individual through-holes 51*a* and 52*a* (refer to FIG. 3) of the first ink holding member 51 and the second ink holding member 52. The diameters of the individual through-holes 51*a* and 52*a* of the first ink holding member 51 and the second ink holding member 52 are set such that the first ink holding member 51 and the second ink holding member 52 are not in contact with the mandrel 20, respectively.

The first ink holding member 51 closes the supply hole 32*a* from the inner circumferential surface of the accommodating unit 32. Ink is supplied to the first ink holding member 51 through the supply hole 32*a*. For example, the user uses an ink supply tool such as a dropper to supply ink from the supply hole 32*a* to the first ink holding member 51. The supplied ink permeates the first ink holding member 51, and further permeates the second ink holding member 52 via the first ink holding member 51. The second ink holding member 52 is formed to not protrude from the lower surface of the accommodating unit 32. Therefore, in the accommodating unit 32, even when the accommodating member 30 abuts against the surface of the workpiece A1, the second ink holding member 52 does not come into contact with the surface of the workpiece A1, and adhesion of the ink to the surface of the workpiece A1 is suppressed.

Here, as the ink, for example, color inks such as red, blue, black, and white are used. For coloring, a color that stands out with respect to the surface color of the workpiece A1, for example, a color different from the color of the workpiece A1 or a color that is not similar to the color, is used. As the first ink holding member 51, for example, a first porous body such as a sponge is used. As the second ink holding member 52, for example, a second porous body such as rubber having multiple holes is used. The first porous body is formed of a material having a larger ink holding amount than that of the second porous body, and the second porous body is formed of a material harder than the first porous body.

Insert Insertion Operation

Figure 4:
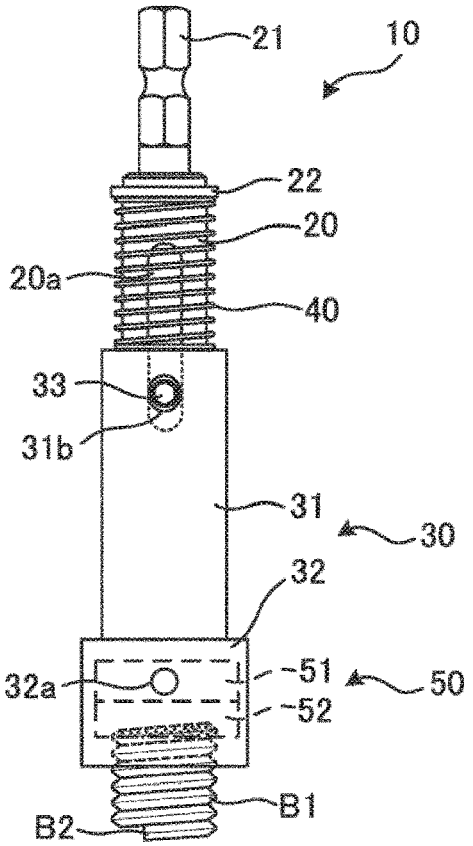
FIG. 4 is a front view illustrating the insert insertion tool, on which an insert has been mounted, according to a first embodiment.
Figure 5:
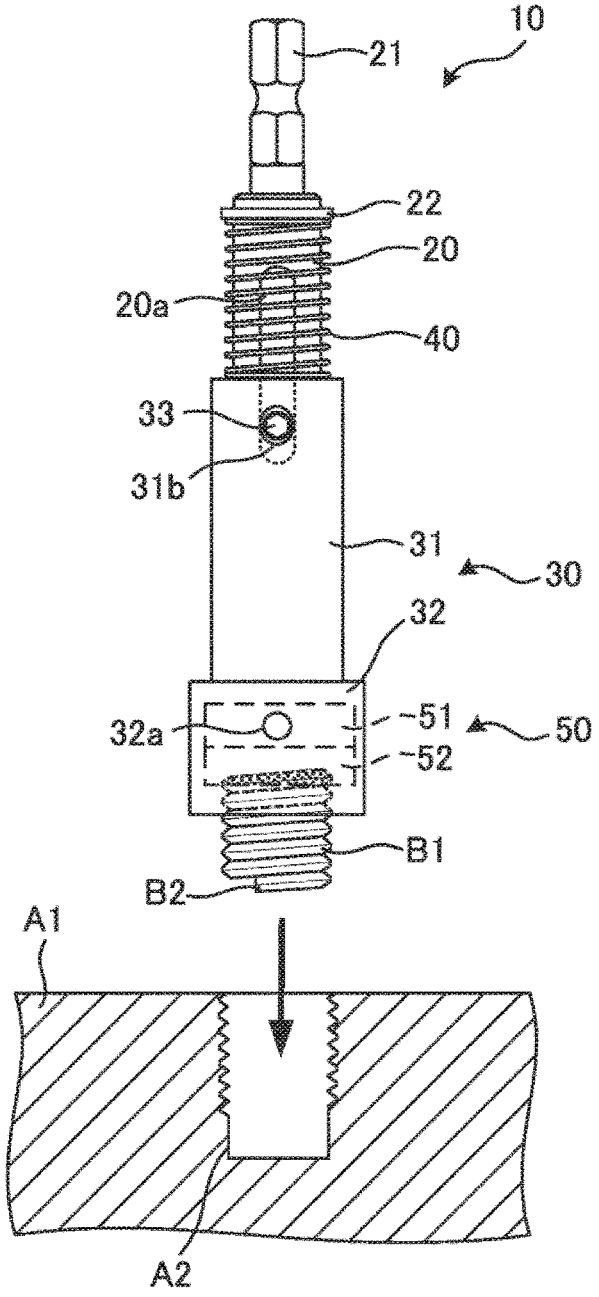
FIG. 5 is a first view for describing an insert insertion operation according to the first embodiment.
Figure 6:
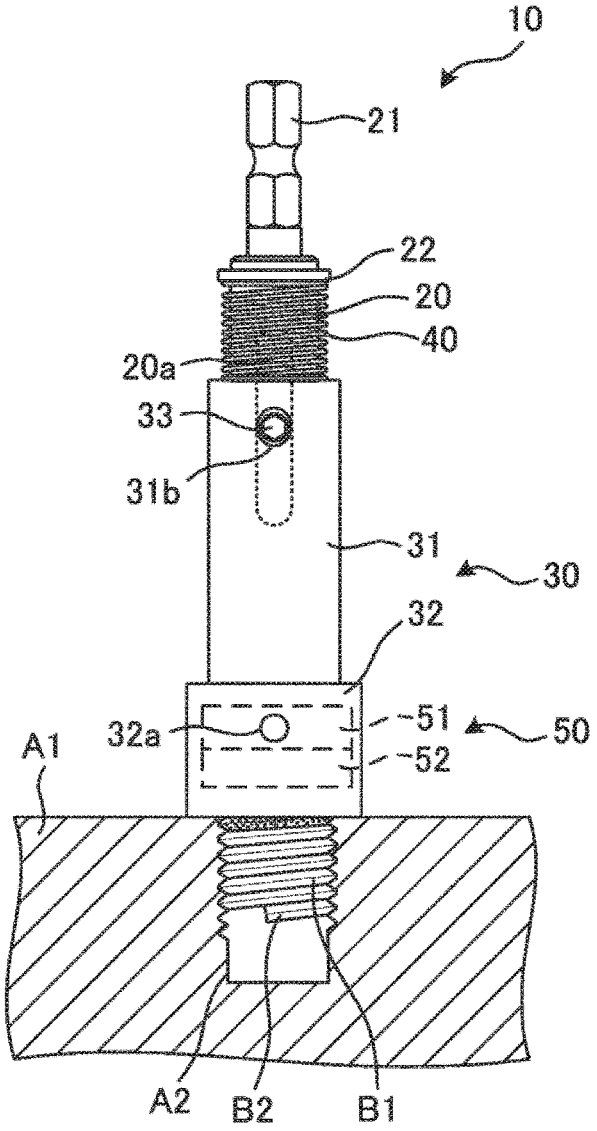
FIG. 6 is a second view for describing the insert insertion operation according to the first embodiment.
Figure 7:
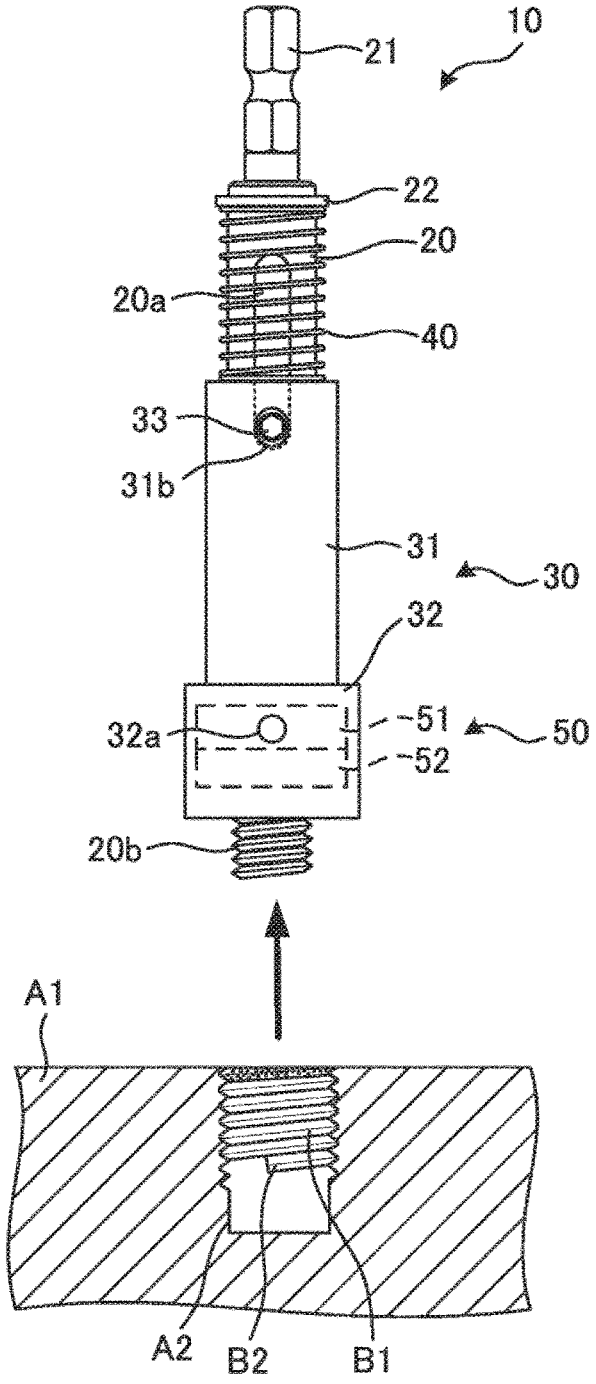
FIG. 7 is a third view for describing the insert insertion operation according to the first embodiment.

Next, an insert insertion operation using the above-described insert insertion tool 10 will be described with reference to FIGS. 4 to 7. In FIGS. 5 to 7, the workpiece A1 and the tap hole A2 are illustrated in a cross section.

The insert B1 is formed by winding a wire rod having a rhombic cross-section (for example, stainless steel) in a coil shape. The outer circumferential surface of the insert B1 functions as an outer thread, and the inner circumferential surface of the insert B1 functions as an inner thread. A tongue B2 bent in the radial direction of the coil is formed at one end portion of the insert B1. When the insert B1 is inserted into the tap hole A2 by the insert insertion tool, the tongue B2 is positioned at the far side of the tap hole A2.

As a step before inserting the insert B1 into the tap hole A2, the mandrel 20 of the insert insertion tool 10 is first mounted by the user on the driving shaft of the automatic screwdriver or the manual rotating jig via the hexagonal bit 21. Next, the insert B1 is mounted on the mandrel 20 of the insert insertion tool 10 by the user. At this time, the user turns only the insert B1, only the insert insertion tool 10, or both of the insert B1 and the insert insertion tool 10 in directions opposite to each other. The insert B1 is mounted on the mandrel 20 by being turned to a position where the tongue B2 is hooked onto the tip end portion of the mandrel 20. At the time of mounting, as illustrated in FIG. 4, the upper surface of the insert B1 comes into contact with the second ink holding member 52, and the ink adheres to and is applied to the upper surface of the insert B1. The upper surface is the rear end on the opposite side of the tip end that first enters the tap hole A2 in the insert B1.

In the mounting process of the insert B1, the upper surface of the insert B1 abuts against the second ink holding member 52, and the insert B1 is mounted on the mandrel 20 while pushing up the second ink holding member 52, that is, the accommodating member 30 that accommodates the coating member 50. At this time, the upper surface of the insert B1 comes into close contact with the lower surface of the second ink holding member 52, and the ink adheres to and is applied to the upper surface of the insert B1. Because the accommodating member 30 is pressed downward by the pressing member 40, the second ink holding member 52 is pressed against the upper surface of the insert B1. The ink may adhere not only to the upper surface of the insert B1 but also to a part of the side surface (either one or both of the inner circumferential surface and the outer circumferential surface) of the insert B1.

As illustrated in FIG. 5, the insert insertion tool 10 on which the insert B1 has been mounted is positioned by the user such that the insert B1 faces the tap hole A2, the insert B1 is turned to enter the tap hole A2, and as illustrated in FIG. 6, the insert B1 is inserted (embedded) while being screwed into the tap hole A2. When the lower surface of the accommodating unit 32 of the accommodating member 30 abuts against the surface of the workpiece A1 and the mandrel 20 does not rotate, the mandrel 20 does not further enter the tap hole A2. Until the lower surface of the accommodating unit 32 of the accommodating member 30 abuts against the surface of the workpiece A1 and the lower surface of the second ink holding member 52 and the upper surface of the insert B1 are separated from each other, the lower surface of the second ink holding member 52 and the upper surface of the insert B1 are in close contact with each other, and the application of ink to the upper surface of the insert B1 is continued.

When the insert B1 is inserted (embedded) into the tap hole A2, the insert insertion tool 10 is automatically or manually turned in the direction opposite to that of the insertion of the insert B1, as illustrated in FIG. 7, the mandrel 20 is removed from the insert B1 inserted into the tap hole A2, and is pulled upward. Ink has been applied to the upper surface of the insert B1 inserted into the tap hole A2. The second ink holding member 52 does not protrude from the inside of the accommodating unit 32, and the second ink holding member 52 does not come into contact with the surface of the workpiece A1. Accordingly, the adhesion of ink to the surface of the workpiece A1 is suppressed.

According to such an insert insertion operation, when the insert B1 is mounted on the insert insertion tool 10, ink is applied to the upper surface of the insert B1 by the second ink holding member 52. Therefore, ink is applied to the upper surface, which is an exposed surface of the insert B1 inserted into the tap hole A2 of the workpiece A1, and the insert B1 inserted into the tap hole A2 stands out on the surface of the workpiece A1. Accordingly, the user is capable of visually recognizing whether or not the insert B1 has been inserted into the tap hole A2. Therefore, the user does not need to try screwing a screw into the insert B1 in the tap hole A2 as before, and thus, it is possible to improve work efficiency. Further, even in a case where a plurality of tap holes A2 are present on the surface of the workpiece A1, when the user looks at the upper surfaces of the inserts B1 in the tap holes A2, it becomes possible to visually recognize whether or not the insert B1 has been inserted into each of the tap holes A2. Accordingly, it is not necessary to perform the above-described work for each tap hole A2, and thus, it is possible to reliably improve the work efficiency.

Usually, an inexpensive silver insert is used as the insert B1, but a colored insert can also be used. However, because the colored insert is expensive, the silver-colored inexpensive insert can be used by using the above-described insert insertion tool 10. Accordingly, it is possible to suppress the use of the colored insert, and thus, it is possible to reduce cost.

As the ink, for example, in addition to color inks such as red, blue, black, and white, it is also possible to use fluorescent ink, phosphorescent ink, reflective ink, light emitting ink, and the like. When these fluorescent ink, reflective ink, light emitting ink, and the like are used, it is preferable to use ink having a color that stands out with respect to the surface color of the workpiece A1. However, the color is not limited thereto, and for example, ink of the same color or similar color as the surface of the workpiece A1 may be used. As the ink, in addition to liquid inks such as pigment ink and dye ink, it is possible to use various inks such as gel ink, powder ink, and solid ink.

As described above, according to the first embodiment, when the insert B1 is mounted on the insert insertion tool 10, ink is applied to the upper surface, which is the exposed surface of the insert B1, by the coating member 50. The insert B1 coated with this ink is inserted into the tap hole A2 of the workpiece A1. Because the insert B1 inserted into the tap hole A2 stands out on the surface of the workpiece A1, the user can visually recognize whether or not the insert B1 has been inserted into the tap hole A2. Therefore, the confirmation work for confirming whether or not the insert B1 has been inserted into the tap hole A2 becomes easy, and it is possible to improve the work efficiency. Further, even in a case where the plurality of tap holes A2 are present on the surface of the workpiece A1, when the user looks at the upper surfaces of the inserts B1 inserted into these tap holes A2, it becomes possible to visually recognize whether or not the insert B1 has been inserted into each of the tap holes A2. Therefore, the confirmation work becomes easy, and it is possible to reliably improve the work efficiency.

Second Embodiment

A second embodiment will be described with reference to FIGS. 8 to 11. The up-down and right-left directions in the second embodiment are based on the drawings. In the second embodiment, the differences from the first embodiment will be described, and other descriptions will be omitted.

Figure 8:
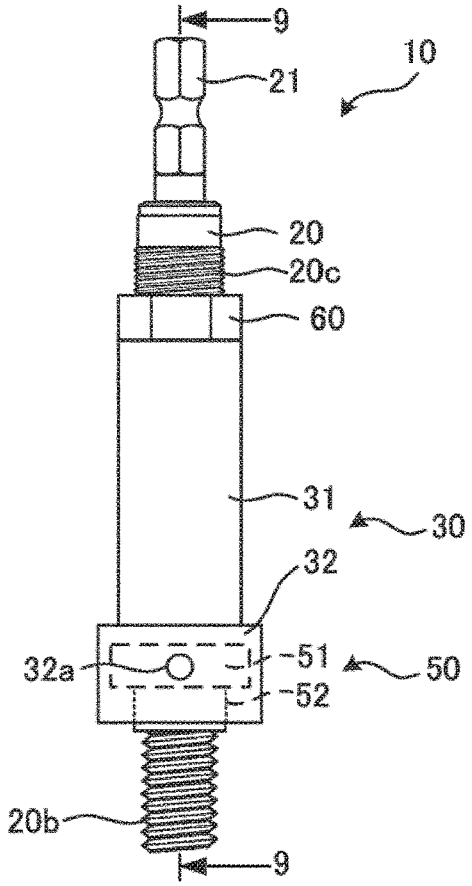
FIG. 8 is a front view illustrating an insert insertion tool according to a second embodiment.
Figure 9:
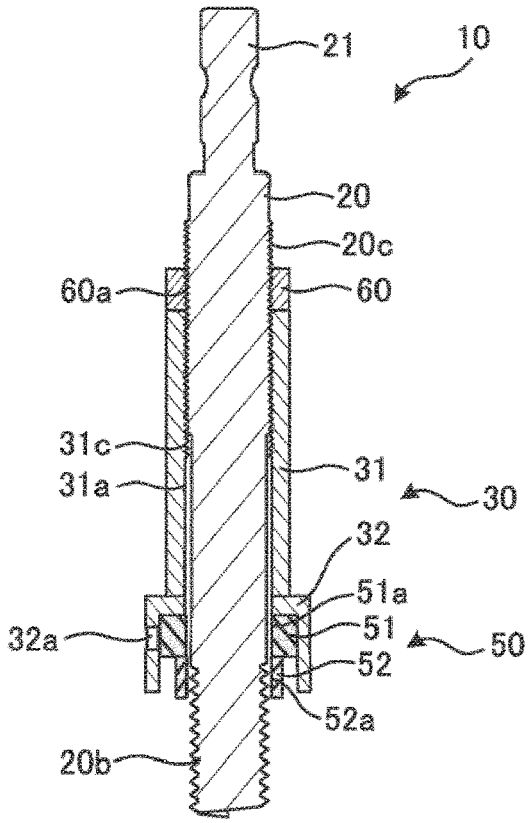
FIG. 9 is a sectional view taken along line 9-9 of FIG. 8.

In the second embodiment, as illustrated in FIGS. 8 and 9, a lock member 60 is provided. Compared to the first embodiment (refer to FIGS. 1 to 3), there are no flange member 22 and pressing member 40, and the main body 31 of the accommodating member 30 does not have the screw hole 31*b* and the male screw 33. Further, there is no groove portion 20*a* on the outer circumferential surface of the mandrel 20.

As illustrated in FIG. 9, a male screw 20*c* is formed on the outer circumferential surface of the mandrel 20 from the vicinity of the root of the hexagonal bit 21 to the vicinity of the center of the mandrel 20. Further, a female screw 31*c* is formed on the inner circumferential surface of the through-hole 31*a* of the main body 31 of the accommodating member 30 from the upper end to the vicinity of the center of the main body 31. The female screw 31*c* of the main body 31 and the male screw 20*c* of the mandrel 20 are combined with each other, and the accommodating member 30 is integrally held by the mandrel 20.

The lock member 60 is a member for fixing the accommodating member 30 to the mandrel 20. As illustrated in FIG. 9, a female screw 60*a* is formed on the inner circumferential surface of the lock member 60. As the lock member 60, for example, a nut is used. The female screw 60*a* of the lock member 60 and the male screw 20*c* of the mandrel 20 are combined with each other, the lower surface of the lock member 60 abuts against the upper surface of the main body 31, and the accommodating member 30 is fixed to the mandrel 20.

Similar to the first embodiment, the coating member 50 has a two-layered structure of the first ink holding member 51 and the second ink holding member 52. The first ink holding member 51 and the second ink holding member 52 are formed in an annular shape, but the outer diameter and the width (ring width) of the rings are different from each other. The outer diameter of the ring of the second ink holding member 52 is shorter than the outer diameter of the ring of the first ink holding member 51, and further shorter than the outer diameter of the insert B1 mounted on the mandrel 20 (refer to FIG. 10). Therefore, the outer circumferential surface of the second ink holding member 52 is separated from the inner circumferential surface of the accommodating unit 32 by a predetermined separation distance (for example, a predetermined horizontal separation distance).

The second ink holding member 52 protrudes from the lower surface of the accommodating unit 32. The protrusion amount of the second ink holding member 52 is set such that, when the lower surface of the accommodating unit 32 abuts against the surface of the workpiece A1, the lower surface of the second ink holding member 52 abuts against the upper surface of the insert B1 inserted into the tap hole A2. When the insert B1 is inserted into the tap hole A2, the upper surface of the insert B1 enters the further side of the tap hole A2 than the surface of the workpiece A1 by a predetermined amount (for example, a predetermined amount within the range of 0.5 to 2 mm) (not illustrated). The protrusion amount of the second ink holding member 52 is appropriately set according to the entering amount. In this manner, the second ink holding member 52 is formed to come into contact with only the upper surface of the insert B1 inserted into the tap hole A2.

Here, when the accommodating member 30 is mounted on the mandrel 20 by the user, the female screw 31*c* of the main body 31 is combined with the male screw 20*c* of the mandrel 20. Further, the combination amount is adjusted, and the protrusion amount of the mandrel 20 that protrudes from the accommodating member 30 is set to a desired amount. In this state, the female screw 60*a* of the lock member 60 is combined with the male screw 20*c* of the mandrel 20 from the upper end side (rear end side) of the mandrel 20 and tightened such that the lower surface of the lock member 60 abuts against the upper surface of the main body 31. In this manner, the accommodating member 30 is mounted on the mandrel 20.

Figure 10:
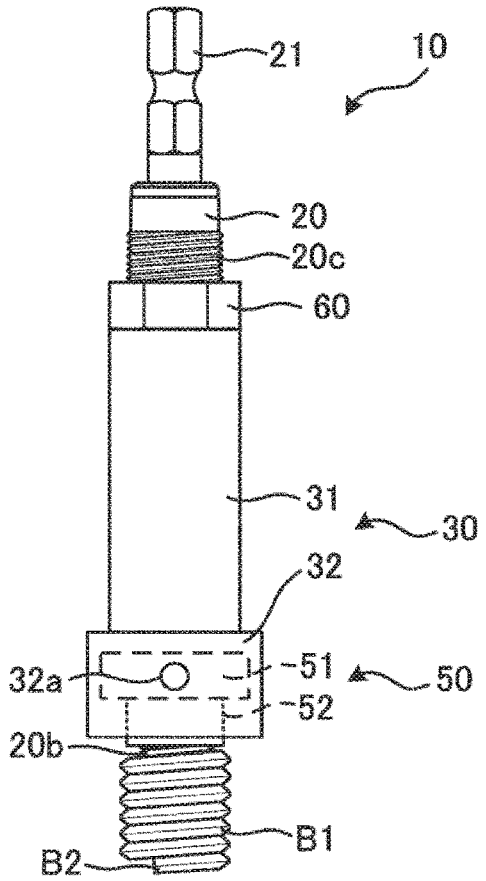
FIG. 10 is a front view illustrating the insert insertion tool, on which an insert has been mounted, according to the second embodiment.

The protrusion amount of the mandrel 20 described above is set according to the depth of the tap hole A2 and the length of the insert B1 (the length of the mandrel 20 in the insert B1 in the extending direction), and is further set so that the upper surface of the insert B1 mounted on the mandrel 20 and the lower surface of the second ink holding member 52 do not come into contact with each other (refer to FIG. 10). The insert B1 mounted on the mandrel 20 is an insert attached to the mandrel 20 in a state where the tip end portion of the mandrel 20 is hooked onto the tongue B2.

Insert Insertion Operation

Figure 11:
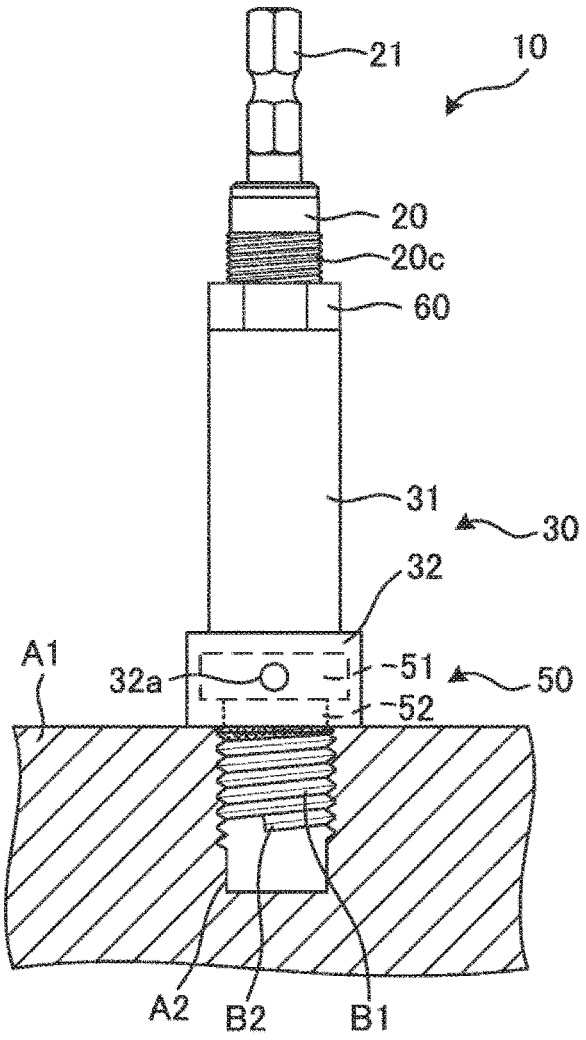
FIG. 11 is a view for describing an insert insertion operation according to the second embodiment.

Next, an insert insertion operation using the above-described insert insertion tool 10 will be described with reference to FIGS. 10 and 11. In FIGS. 10 and 11, the workpiece A1 and the tap hole A2 are illustrated in a cross section.

Similar to the first embodiment, as a step before inserting the insert B1 into the tap hole A2, the mandrel 20 of the insert insertion tool 10 is first mounted by the user on the driving shaft of the automatic screwdriver or the manual rotating jig via the hexagonal bit 21. Next, the insert B1 is mounted on the mandrel 20 of the insert insertion tool 10 by the user. At this time, the user turns only the insert B1, only the insert insertion tool 10, or both of the insert B1 and the insert insertion tool 10 in directions opposite to each other. The insert B1 is mounted on the mandrel 20 by being turned to a position where the tongue B2 is hooked onto the tip end portion of the mandrel 20. Unlike the first embodiment, as illustrated in FIG. 10, the upper surface of the insert B1 does not come into contact with the second ink holding member 52 at the time of mounting, and the ink is not applied to the upper surface of the insert B1.

The insert insertion tool 10 on which the insert B1 has been mounted is positioned by the user such that the insert B1 faces the tap hole A2, the insert B1 is turned to enter the tap hole A2. As illustrated in FIG. 11, the insert B1 is screwed into the tap hole A2 and inserted (embedded). When the lower surface of the accommodating unit 32 of the accommodating member 30 abuts against the surface of the workpiece A1 and the mandrel 20 does not rotate, the mandrel 20 does not further enter the tap hole A2. During this operation, when the lower surface of the second ink holding member 52 abuts against the upper surface of the insert B1 inserted into the tap hole A2, the lower surface of the second ink holding member 52 and the upper surface of the insert B1 come into close contact with each other, and ink adheres to and is applied to the upper surface of the insert B1. Because the upper surface of the insert B1 enters the further tap hole A2 side than the surface of the workpiece A1, the height position of the upper surface of the insert B1 is lower than the height position of the surface of the workpiece A1 (not illustrated).

When the insert B1 is inserted (embedded) into the tap hole A2, the insert insertion tool 10 is automatically or manually turned in the direction opposite to that of the insertion of the insert B1. The mandrel 20 is removed from the insert B1 inserted into the tap hole A2, and is pulled upward. Ink has been applied to the upper surface of the insert B1 inserted into the tap hole A2. Although the second ink holding member 52 protrudes from the inside of the accommodating unit 32, the contact of the second ink holding member 52 with the surface of the workpiece A1 is suppressed, and the adhesion of the ink to the surface of the workpiece A1 is suppressed.

In other words, the second ink holding member 52 is formed such that the outer diameter thereof is shorter than the outer diameter of the insert B1. Accordingly, even when the second ink holding member 52 comes into contact with the insert B1 inserted into the tap hole A2, contact with the periphery of the insert B1 is suppressed. Therefore, it is possible to suppress the contact of the second ink holding member 52 with the surface of the workpiece A1 so that the ink adheres to the surface of the workpiece A1. The second ink holding member 52 is formed such that the outer circumferential surface thereof is separated from the inner circumferential surface of the accommodating unit 32 by a predetermined separation distance. Therefore, when the second ink holding member 52 abuts against the insert B1 inserted into the tap hole A2, the second ink holding member 52 easily deforms. An excessive force is not applied to the second ink holding member 52, and thus, it becomes possible to suppress flowing of a large amount of ink from the second ink holding member 52. Accordingly, it is possible to suppress discharge of a large amount of ink from the second ink holding member 52 so that the ink adheres to the surface of the workpiece A1.

According to such an insert insertion operation, when the insert B1 is inserted into the tap hole A2 of the workpiece A1, ink is applied to the upper surface of the insert B1 by the second ink holding member 52. Therefore, similar to the first embodiment, ink is applied to the upper surface, which is an exposed surface of the insert B1 inserted into the tap hole A2 of the workpiece A1, and the insert B1 inserted into the tap hole A2 stands out on the surface of the workpiece A1. Accordingly, the user is capable of visually recognizing whether or not the insert B1 has been inserted into the tap hole A2. Therefore, the user does not need to try screwing a screw into the insert B1 in the tap hole A2 as before, and thus, it is possible to improve the work efficiency. Further, even in a case where a plurality of tap holes A2 are present on the surface of the workpiece A1, when the user looks at the upper surfaces of the inserts B1 in the tap holes A2, it becomes possible to visually recognize whether or not the insert B1 has been inserted into each of the tap holes A2. Accordingly, it is not necessary to perform the above-described work for each tap hole A2, and thus, it is possible to reliably improve the work efficiency.

As described above, according to the second embodiment, the same effect as that of the first embodiment can be obtained. In other words, when the insert B1 is inserted into the tap hole A2 of the workpiece A1, the ink is applied to the upper surface, which is the exposed surface of the insert B1, by the coating member 50. Accordingly, because the insert B1 inserted into the tap hole A2 stands out on the surface of the workpiece A1, the user is capable of visually recognizing whether or not the insert B1 has been inserted into the tap hole A2. Therefore, the confirmation work for confirming whether or not the insert B1 has been inserted into the tap hole A2 becomes easy, and it is possible to improve the work efficiency. Even when the plurality of tap holes A2 are present, the confirmation work becomes easy, and thus, it is possible to reliably improve the work efficiency.

Other Embodiments

In the above, as the insert insertion tool 10, the insert insertion tool corresponding to the insert with a tongue having the tongue B2 is described as an example, but the present invention is not limited thereto, and various members such as a pawl having a hook unit may be added to the mandrel 20. Further, an insert insertion tool corresponding to a tongueless insert that does not have the tongue B2 may be used. In addition to the insert with a tongue or the tongueless insert, the insert B1 may be an Ilisert® screw-in type insert or an Ensat® self-cutting type insert, and an insert insertion tool that corresponds thereto may be used. In other words, it is possible to use an insert insertion tool that corresponds to various types of inserts.

In the above, an example is described in which the coating member 50 is made of two layers of the first ink holding member 51 and the second ink holding member 52, but the present invention is not limited thereto. For example, the coating member 50 may be made of one layer of either the first ink holding member 51 or the second ink holding member 52. The layer configuration made of different members may have three or more layers instead of two or one layer. In the first ink holding member 51 and the second ink holding member 52, the shapes, sizes, materials, and the like may be the same or different from each other. Although only one supply hole 32*a* for supplying ink to the coating member 50 is formed in the accommodating unit 32, the present invention is not limited thereto. A plurality of supply holes 32*a* may be provided.

In the above, an example is described in which ink is applied to the upper surface of the insert B1, but the present invention is not limited thereto. At least the upper surface of the insert B1 may be coated with the ink, and for example, in addition to the upper surface of the insert B1, the side surface (either one or both of the inner circumferential surface and the outer circumferential surface) of the insert may be coated. Not only to the uppermost first roll of the insert B1 but also to the side surfaces of the second and third rolls may also be coated. The ink may be applied to at least a part of the upper surface of the insert B1, but it is preferable to apply the ink to the entire upper surface of the insert B1.

In the above, an example is described in which the first ink holding member 51 and the second ink holding member 52 are formed in the same annular shape, but the present invention is not limited thereto. For example, the first ink holding member 51 and the second ink holding member 52 may be formed in different shapes, respectively. For example, the first ink holding member 51 may be formed in an annular shape, and the second ink holding member 52 may be formed in a shape that is half (½) of the ring. Either one or both of the first ink holding member 51 and the second ink holding member 52 may be formed in a shape such as ½, ⅓, or ¼ of the ring. Otherwise, a plurality of small pieces of the porous body may be prepared as the ink holding member, and these small pieces may be provided side by side at a ring interval. For example, an even number of small pieces such as two or four may be prepared and disposed to face each other with the mandrel 20 in between. If necessary, the supply hole 32*a* may be formed in the accommodating unit 32 for each small piece of the porous body.

Here, even when the second ink holding member 52 that comes into contact with the upper surface of the insert B1 is not formed in an annular shape, the second ink holding member 52 comes into contact with at least a part of the upper surface of the insert B1. Accordingly, the ink is supplied from the second ink holding member 52 to a part of the upper surface of the insert B1 and spreads over the entire upper surface of the insert B1 according to viscosity of the ink and wettability of the upper surface of the insert B1, and ink is applied to the entire upper surface of the insert B1. When the viscosity of ink is high and the wettability of the upper surface of the insert B1 is poor, the ink supplied to a part of the upper surface of the insert B1 does not spread over the entire upper surface of the insert B1, but ink is applied to at least a part of the upper surface of the insert B1. Therefore, because the insert B1 inserted into the tap hole A2 stands out on the surface of the workpiece A1, the user is capable of easily visually recognizing whether or not the insert B1 has been inserted into the tap hole A2.

Although the above-described embodiments according to the invention have been described above, the above-described embodiments are examples and do not limit the scope of the invention. It is possible to change the above-described embodiments in various manners. For example, the configuration elements illustrated in the above-described embodiments may be omitted, replaced, or changed, and the configuration elements according to different embodiments may be combined as appropriate. The above-described embodiments or modifications thereof are included in the scope of the invention described in the claims and the equivalent scope thereof.

REFERENCE SIGNS LIST

10 insert insertion tool
20 mandrel
20*a* groove portion
20*b* male screw
20*c* male screw
21 hexagonal bit
22 flange member
30 accommodating member
31 main body
31*a* through-hole
31*b* screw hole
31*c* female screw
32 accommodating unit
32*a* supply hole
33 male screw
40 pressing member
50 coating member
51 first ink holding member
51*a* through-hole
52 second ink holding member
52*a* through-hole
60 lock member
60*a* female screw
A1 workpiece
A2 tap hole
B1 insert
B2 tongue

The invention claimed is:

1. An insert insertion tool comprising:

a mandrel on which an insert is mounted so that a portion of the mandrel extends into the insert; and a coating member configured to apply ink to a rear end on an opposite side of a tip end that first enters a tap hole, of the insert, wherein the coating member has an ink holding member that holds the ink, and the ink holding member is in contact with the rear end of the insert mounted on the mandrel.

2. The insert insertion tool according to claim 1, further comprising:

an accommodating member configured to accommodate the coating member, wherein the accommodating member has a supply hole for supplying the ink to the coating member.

3. The insert insertion tool according to claim 1, wherein the ink holding member is formed to be movable along an extending direction of the mandrel, and the insert insertion tool further comprises a pressing member for pressing the ink holding member against the rear end of the insert mounted on the mandrel.

4. The insert insertion tool according to claim 3, further comprising:

an accommodating member configured to accommodate the coating member, wherein the accommodating member has a supply hole for supplying the ink to the coating member.

5. The insert insertion tool according to claim 1, wherein the insert is a wire rod formed in a coil shape to provide an inner thread for the tap hole.

6. The insert insertion tool according to claim 5, wherein the insert has a rhombic cross-section.

7. A method for inserting an insert comprising:

mounting an insert on a mandrel provided in an insert insertion tool so that a portion of the mandrel extends into the insert;

applying ink to a rear end on an opposite side of a tip end that first enters a tap hole, of the insert mounted on the mandrel by a coating member provided in the insert insertion tool; and inserting the ink-coated insert into the tap hole by the insert insertion tool.

8. A method for inserting an insert comprising:

mounting an insert on a mandrel provided in an insert insertion tool;

inserting the insert mounted on the mandrel into a tap hole by the insert insertion tool; and applying ink to a rear end on an opposite side of a tip end that first enters the tap hole of the insert inserted into the tap hole by a coating member provided in the insert insertion tool.

9. An insert insertion tool comprising:

a mandrel on which an insert is mounted so that a portion of the mandrel extends into the insert; and a coating member configured to apply ink to a rear end on an opposite side of a tip end that first enters a tap hole, of the insert, wherein the coating member has an ink holding member that holds the ink, and the ink holding member is in contact with the rear end of the insert inserted into the tap hole.

10. The insert insertion tool according to claim 9, further comprising:

an accommodating member configured to accommodate the coating member, wherein the accommodating member has a supply hole for supplying the ink to the coating member.

11. The insert insertion tool according to claim 9, wherein the ink holding member is in contact with the rear end of the insert mounted on the mandrel.

12. The insert insertion tool according to claim 11, further comprising:

an accommodating member configured to accommodate the coating member, wherein the accommodating member has a supply hole for supplying the ink to the coating member.

* * * * *